US010344720B2

(12) United States Patent
Ito

(10) Patent No.: US 10,344,720 B2
(45) Date of Patent: Jul. 9, 2019

(54) INTAKE APPARATUS OF INTERNAL COMBUSTION ENGINE

(71) Applicant: AISIN SEIKI KABUSHIKI KAISHA, Kariya-shi, Aichi (JP)

(72) Inventor: Atsushi Ito, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 15/565,771

(22) PCT Filed: Mar. 31, 2016

(86) PCT No.: PCT/JP2016/060594
§ 371 (c)(1),
(2) Date: Oct. 11, 2017

(87) PCT Pub. No.: WO2016/170945
PCT Pub. Date: Oct. 27, 2016

(65) Prior Publication Data

US 2018/0119655 A1 May 3, 2018

(30) Foreign Application Priority Data

Apr. 20, 2015 (JP) ..... 2015-085913

(51) Int. Cl.
*F02M 35/00* (2006.01)
*F02M 35/10* (2006.01)
(Continued)

(52) U.S. Cl.
CPC ..... *F02M 35/10222* (2013.01); *F02M 26/17* (2016.02); *F02M 26/20* (2016.02);
(Continued)

(58) Field of Classification Search
None
See application file for complete search history.

(56) References Cited

U.S. PATENT DOCUMENTS 7,451,732 B1 * 11/2008 Vichinsky ..... F02M 25/089 123/184.42
8,511,289 B2 * 8/2013 Tanikawa ..... F02M 35/10039 123/184.42
(Continued)

FOREIGN PATENT DOCUMENTS

DE 10 2010 051 857 A1 5/2011
EP 3 184 791 A1 6/2017
(Continued)

OTHER PUBLICATIONS

The extended European Search Report dated Apr. 10, 2018, by the European Patent Office in corresponding European Patent Application No. 16782967.0-1004. (10 pages).
(Continued)

*Primary Examiner* — Hieu T Vo
*Assistant Examiner* — Sherman D Manley
(74) *Attorney, Agent, or Firm* — Buchanan Ingersoll & Rooney PC

(57) ABSTRACT

An intake apparatus of an internal combustion engine includes an intake apparatus main body including plural intake pipes being connected to cylinders of the internal combustion engine, respectively, the internal combustion engine having the plural cylinders, and an external gas passage distributing an external gas to each of the plural intake pipes. The intake apparatus main body is formed such that plural pieces being formed so as to be divided from one another is joined with one another, and the plural intake pipes are formed so as to be curved. The external gas passage is disposed at an inner circumferential side of the plural curved intake pipes, the external gas passage being provided at a joint surface of the plural pieces constituting an inner circumferential part of the plural curved intake pipes.

6 Claims, 2 Drawing Sheets

(51) Int. Cl.

| | |
|---|---|
| ***F02M 35/104*** | (2006.01) |
| ***F02M 35/112*** | (2006.01) |
| ***F02M 26/17*** | (2016.01) |
| ***F02M 26/20*** | (2016.01) |

(52) U.S. Cl.
CPC .... *F02M 35/104* (2013.01); *F02M 35/10144* (2013.01); *F02M 35/112* (2013.01)

(56) References Cited

U.S. PATENT DOCUMENTS

| | | | | |
|---|---|---|---|---|
| 9,057,346 | B2 * | 6/2015 | Sato | F02M 35/10072 |
| 2006/0191505 | A1 * | 8/2006 | Doko | F02M 35/10039 123/184.59 |
| 2009/0223476 | A1 * | 9/2009 | Shinkai | F02M 26/12 123/184.21 |
| 2014/0338628 | A1 * | 11/2014 | Ito | F02M 35/10091 123/184.55 |
| 2017/0211519 | A1 * | 7/2017 | Ito | F02M 35/104 |
| 2017/0306895 | A1 * | 10/2017 | Teramoto | F02M 35/104 |
| 2018/0171944 | A1 * | 6/2018 | Nakamura | F02M 35/104 |
| 2018/0179999 | A1 * | 6/2018 | Yoshioka | F02M 35/10144 |

FOREIGN PATENT DOCUMENTS

| | | | |
|---|---|---|---|
| JP | S61-187520 | A | 8/1986 |
| JP | 63-068762 | A | 3/1988 |
| JP | H01-095563 | U | 6/1989 |
| JP | 2000-008968 | A | 1/2000 |
| JP | 2003-239816 | A | 8/2003 |
| JP | 2013-019315 | A | 1/2013 |
| JP | 2013-068129 | A | 4/2013 |
| WO | 2016/072355 | A1 | 5/2016 |

OTHER PUBLICATIONS

The partial supplementary European Search Report (R. 164 EPC) dated Jan. 31, 2018, by the European Patent Office in corresponding European Patent Application No. 16782967.0-1004. (13 pages).
International Search Report (PCT/ISA/210) dated Jun. 14, 2016, by the Japanese Patent Office as the International Searching Authority for International Application No. PCT/JP2016/060594.
Written Opinion (PCT/ISA/237) dated Jun. 14, 2016, by the Japanese Patent Office as the International Searching Authority for International Application No. PCT/JP2016/060594.
Office Action (Communication pursuant to Article 94(3) EPC) dated Mar. 8, 2019, by the European Patent Office in corresponding European Patent Application No. 16 782 967.0-1004. (6 pages).

* cited by examiner

INTAKE APPARATUS OF INTERNAL COMBUSTION ENGINE

TECHNICAL FIELD

The present invention relates to an intake apparatus of an internal combustion engine, in particular, the intake apparatus of the internal combustion engine that includes an intake apparatus main body being connected to the internal combustion engine having plural cylinders.

BACKGROUND ART

An intake apparatus of an internal combustion engine including an intake apparatus main body being connected to the internal combustion engine having plural cylinders is known. Such intake apparatus of the internal combustion engine is disclosed in, for example, JP2000-8968A.

In JP2000-8968A, an exhaust gas recirculation apparatus of an internal combustion engine in which a resin-made intake manifold is connected to the in-line three-cylinder internal combustion engine is disclosed. In the exhaust gas recirculation apparatus of the internal combustion engine disclosed in JP2000-8968A, a downstream end of the intake manifold (the intake apparatus main body) having curved intake passages is connected to a cylinder head via a spacer member and a gasket. Meanwhile, in the spacer member, a recessed portion and groove-shaped three passages branched from the recessed portion are formed at a joint surface side of the spacer member relative to the gasket. The gasket is formed with through holes passing through intake pipes of the cylinder head, respectively, at positions corresponding to end portions of the three passages of the spacer member. By the attachment of the spacer member to the cylinder head via the gasket, a collective chamber and EGR gas branch passages (external gas passages) are configured to be formed, the collective chamber being provided at the joint surface between the spacer member and the gasket and taking in an EGR gas (an external gas) from an exhaust port of the internal combustion engine, the EGR gas branch passages (external gas passages) distributing the EGR gas taken in the collective chamber to the intake pipes of the cylinder head, respectively.

DOCUMENT OF PRIOR ART

Patent Document

Patent document 1: JP2000-8968A

OVERVIEW OF INVENTION

Problem to be Solved by Invention

However, in the exhaust gas recirculation apparatus of the internal combustion engine disclosed in JP2000-8968A, a mounting position of the intake manifold is spaced away from the cylinder head by a thickness of the spacer member since the spacer member being formed with the EGR gas branch passages is provided between the intake manifold and the cylinder head. Accordingly, there is a problem in which the entire intake apparatus including the spacer member may increase the size. Furthermore, because the spacer member formed with the EGR gas branch passages has to be provided other than the intake manifold, there is a problem in which the number of components constituting the whole intake apparatus may increase accordingly.

The present invention is provided to solve the aforementioned problem, and an object of the present invention is to provide an intake apparatus of an internal combustion engine which may inhibit both of an upsizing of the entire intake apparatus and the number of components.

Means for Solving Problem

To achieve the above-described object, an intake apparatus of an internal combustion engine according to an aspect of the present invention includes an intake apparatus main body including plural intake pipes being connected to cylinders of the internal combustion engine, respectively, the internal combustion engine having the plural cylinders, and an external gas passage distributing an external gas to each of the plural intake pipes. The intake apparatus main body is formed such that plural pieces being formed so as to be divided from one another is joined with one another, and the plural intake pipes are formed so as to be curved. The external gas passage is disposed at an inner circumferential side of the plural curved intake pipes, the external gas passage being provided at a joint surface of the plural pieces constituting an inner circumferential part of the plural curved intake pipes.

According to the intake apparatus of the internal combustion engine of the aspect of the present invention, as described above, the external gas passage may be disposed by efficiently using a space part (a vacant space) of an inner circumferential side of the curved plural intake pipes by the positioning of the external gas passage at the inner circumferential side of the curved plural intake pipes. Accordingly, the whole intake apparatus may be inhibited from being increased in size. Moreover, as the intake apparatus is inhibited from being increased in size, the mountability to an engine room of a vehicle may be enhanced. Because the external gas passage may be integrally provided at the intake apparatus by using the plural pieces constituting the inner circumferential part of the plural intake pipes by the provision of the external gas passage to the joint surface of the plural pieces constituting the inner circumferential part of the curved plural intake pipes. Accordingly, the intake apparatus may be inhibited from increasing the number of components.

According to the intake apparatus of the internal combustion engine of the aforementioned aspect, the intake apparatus main body is formed such that the plural pieces being formed so as to be divided from one another is joined with one another, and the external gas passage is disposed at the joint surface of the plural pieces constituting the inner circumferential part of the plural curved intake pipes. Accordingly, an exclusive piece constituting the external gas passage does not have to be provided, and the external gas passage may be formed integrally at the same time of the formation of the intake apparatus main body (the joint of the plural pieces). Accordingly, the intake apparatus of which the man-hour at the time of the joint process is reduced may be obtained.

According to the intake apparatus of the internal combustion engine of the aforementioned aspect, favorably, the external gas passage includes a single gas introduction passage portion being provided so as to extend in an arrangement direction of the plural intake pipes, the gas introduction passage portion introducing the external gas, and plural gas distribution passage portions being provided so as to connect the gas introduction passage portion and the plural intake pipes, the gas distribution passage portions distributing the external gas introduced to the gas introduction passage portion to each of the intake pipes.

With this configuration, by the efficient use of the space part (vacant space) at the inner circumferential side of the plural curved intake pipes, the distribution structure of the external gas being provided with the single gas introduction passage portion and the plural gas distribution passage portions dividing the external gas to each of the plural intake pipes from the gas introduction passage portion may be easily provided.

According to the intake apparatus of the internal combustion engine of the aforementioned aspect, favorably, the plural intake pipes is formed so as to be curved until an upstream end of the plural intake pipes faces an intermediate portion of the plural intake pipes, and the external gas passage is disposed at an area where the upstream end and the intermediate portion of the plural curved intake pipes face with each other.

With this configuration, the external gas passage may be integrally provided with the intake apparatus main body, the external gas passage that is formed by the plural pieces constituting the inner circumferential part of the intake pipes at the curved inner circumferential side that is curved until the upstream end and the intermediate portion of the plural intake pipes face with each other. Accordingly, the rigidity of the intake apparatus main body configured by the curved plural intake pipes may be enhanced by the efficient use of the space part (vacant space) at the inner circumferential side of the plural intake pipes and by positioning the external gas passage.

According to the configuration of the external gas passage including the single gas introduction passage portion and the plural distribution passage portions, favorably, the plural pieces constituting the inner circumferential part of the curved intake pipes is provided with a first piece including a first passage component and a second piece including a second passage component. The gas introduction passage portion is formed such that the first passage component of the first piece and the second passage component of the second piece are joined with each other in a state of being disposed so as to face with each other. The gas distribution passage portion is formed in a hole shape at the second piece.

With this configuration, because the plural gas distribution passage portions dividing the external gas to each of the intake pipes are integrally provided with the second piece side so as to be formed in a hole shape at the second piece, the shape of the gas distribution passage portions is not distorted caused by the difference at the time of the joint even in a case where the difference occurs between the first piece and the second piece at the time of the joint. That is, since the passage cross-sectional area (the passage cross-sectional shape) of the gas distribution passage portions is not affected by the difference between the first piece and the second piece when being joined with each other, the distribution precision of the external gas circulating in each of the gas distribution passage portions, the distribution precision to the corresponding intake pipes, may be highly maintained.

According to the configuration of the external gas passage including the single gas introduction passage portion and the plural distribution passage portions, favorably, the plural gas distribution passage portions is provided so as to open towards a downstream side at an inner wall surface of each of the intake pipes.

With this configuration, because the external gas sent from the gas distribution passage portions is introduced towards the downstream in the intake flow direction of the intake pipes, the external gas introduced to each of the intake pipes caused by the intake pulsation of the internal combustion engine when the cylinders perform the cycle of suction, compression, expansion (combustion), and exhaustion while including predetermined phase differences from one another is inhibited from flowing back towards the upstream side in the intake flow direction. That is, even in a case where the engine generates the intake pulse, the distribution precision of the external gas to the intake pipes may be highly maintained.

According to the intake apparatus of the internal combustion engine of the aforementioned aspect, favorably, the external gas corresponds to an exhaustion gas recirculation gas.

With this configuration, the external gas (the Exhaust Gas Recirculation gas) circulating in the external gas passage is inhibited from being directly affected with external air (external temperature) by the intake apparatus main body (the plural pieces constituting the inner circumferential part of the plural curved intake pipes). Accordingly, even in a case where the internal combustion engine is operated under the condition of a low external temperature (below-zero temperature), the warm EGR gas is inhibited from being cooled within the external gas passage by being affected by an external air (for example, a travelling wind) because the heat retaining properties of the external gas passage are enhanced. That is, because the water (the water vapor) included in the EGR gas that is recirculated to the internal combustion engine may be inhibited from being condensed by being cooled within the external gas passage portion, the accidental fire may be inhibited from occurring at a combustion chamber. Furthermore, a deposit (an attachment) caused by the condensed water may be inhibited from being generated in the external gas passage. As a result, the internal combustion engine performance (fuel consumption) may be enhanced while inhibiting the internal combustion engine quality from degrading.

According to the intake apparatus of the internal combustion engine of the aforementioned aspect, favorably the upstream end of the plural intake pipes is connected to a surge tank, and the external gas passage is disposed at an area where the surge tank and the intermediate portion of the plural intake pipes face with each other.

With this configuration, even the intake apparatus main body in which a surge tank temporarily stores the intake air passing through a throttle valve is provided at the upstream of the plural intake pipes, the external gas passage may be provided by the effective use of the vacant space where the surge tank and the intermediate portion of the plural intake pipes face with each other. As a result, the mountability of the intake apparatus including the surge tank to the engine room may be efficiently enhanced.

MODE FOR CARRYING OUT THE INVENTION

Hereinafter, an embodiment of the present invention will be explained based on the drawings.

An intake apparatus 100 of the embodiment of the present invention will be explained with reference to FIGS. 1 to 3.

(Schematic Configuration of an Engine and the Intake Apparatus)

Figure 1:
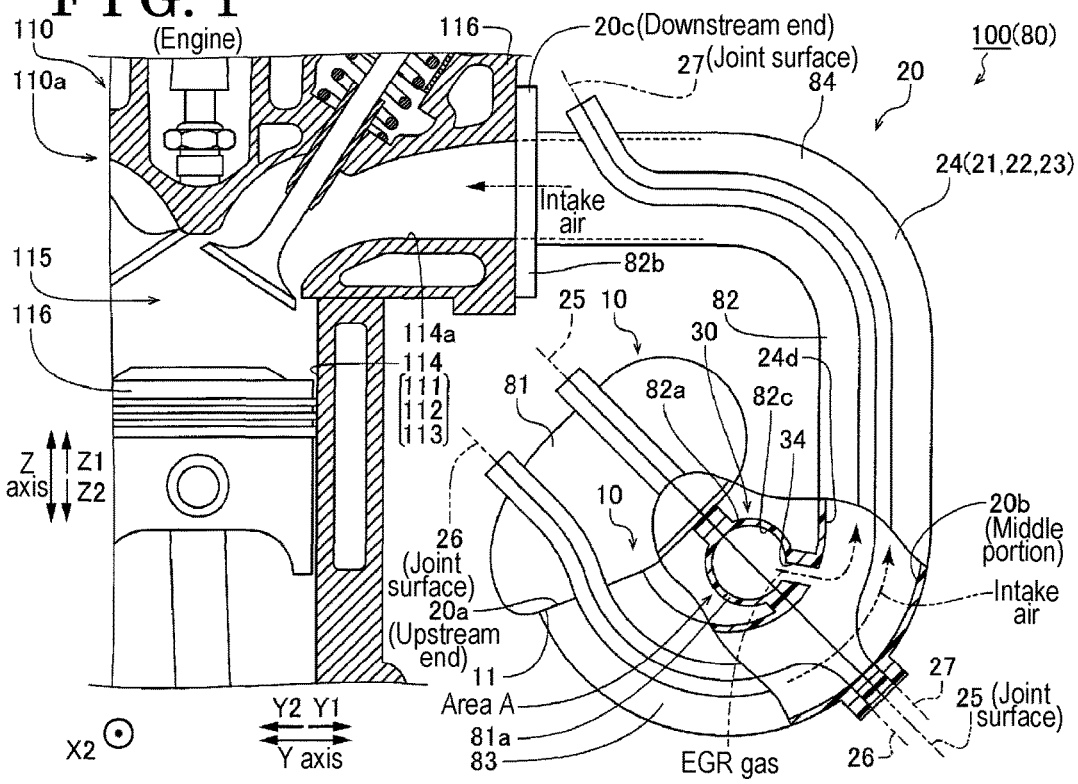
FIG. 1 is a side view of an intake apparatus of an embodiment of the present invention seen along a cylinder row of an engine.

As shown in FIG. 1, the intake apparatus 100 (an intake apparatus of an internal combustion engine) is mounted on an in-line four-cylinder engine 110 (an example of the internal combustion engine). Four cylinders 111 to 114 are lined in a row in an order of a first cylinder, a second cylinder, a third cylinder, and a fourth cylinder from a back of a document surface to a front thereof. Meanwhile, a cylinder row direction (an X-axis direction) corresponds to an extending direction of a crankshaft (not illustrated) provided downward of the cylinders 111 to 114. The intake apparatus 100 is provided with an intake apparatus main body 80 including a surge tank 10 and an intake pipe portion 20 being connected to a downstream side in an intake flow direction.

The engine 110 is mounted within an engine room (not illustrated) of an automobile in a state of being mounted with the intake apparatus 100. The engine 110 is configured such that an Exhaust Gas Recirculation gas (an EGR gas) serving as a part of an exhaust gas discharged from a combustion chamber 115 (the cylinders 111 to 114) is recirculated to an engine main body 110*a*.

Figure 2:
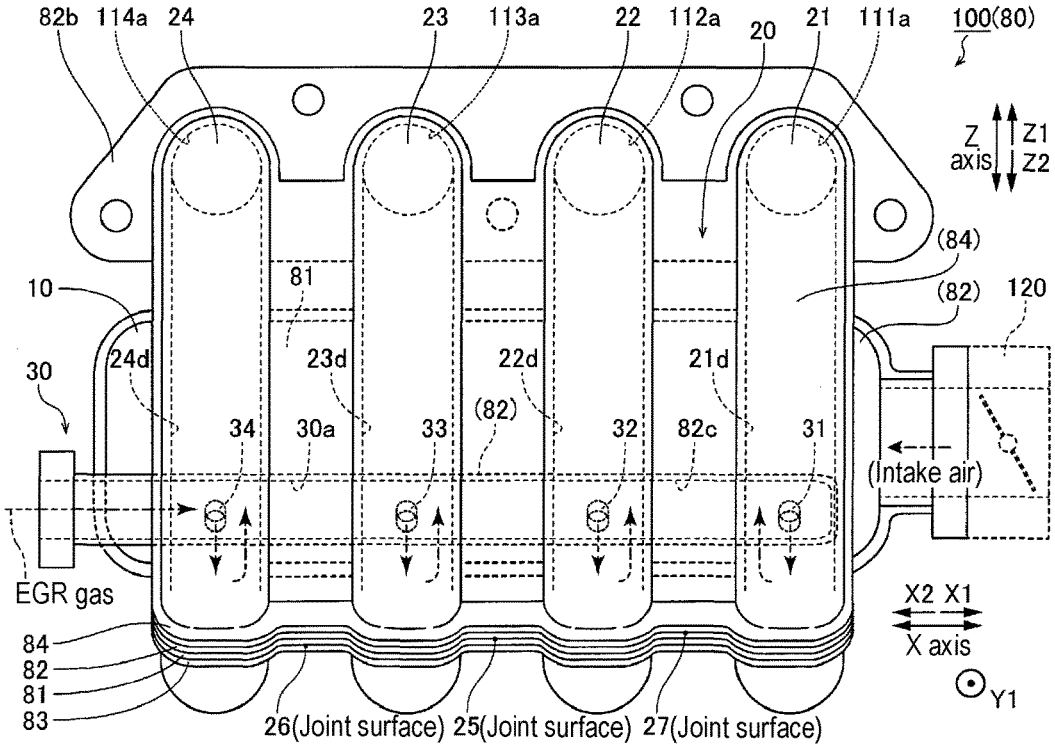
FIG. 2 is a view in a case where the intake apparatus of the embodiment of the present invention is seen from a side of the engine.

As shown in FIG. 2, a surge tank 10 extends along the cylinder row (the X-axis direction) of an engine main body 110*a* (see FIG. 1). In the intake pipe portion 20, intake pipes 21, 22, 23, 24 are lined along the cylinder row from an X1 side towards an X2 side, and includes a role distributing an air accumulated in the surge tank 10 to intake ports 111*a* to 114*a* within a cylinder head 116 (see FIG. 1). In FIG. 2, the illustration of the engine 110 (see FIG. 1) disposed at the backside of the document relative to the intake apparatus main body 80 is omitted for convenience. A throttle valve 120 (shown with a dotted line) is connected at an upstream side (the X1 side) of the surge tank 110.

As illustrated in FIG. 1, an upstream end 20*a* of the intake pipe portion 20 is connected to a side wall portion 11 inclined obliquely downward of the surge tank 10, and the intake pipe portion 20 is curved in the anticlockwise direction (approximately 120 degrees) so as to be away from the engine main body 110*a* at a section from the upstream end 20*a* to an intermediate portion 20*b*. That is, the intake pipes 21 to 24 are formed to be curved until the upstream end 20*a* almost faces the intermediate portion 20*b*. The intake pipe portion 20 is re-curved in the anticlockwise direction (approximately 90 degrees) at an obliquely upward of the surge tank 10 after linearly extending by a predetermined distance from the intermediate portion 20*b* to upward (an arrow Z1 direction), and a downstream end 20*c* is connected to the cylinder head 116 (the intake ports 111*a* to 114*a*). The downstream end 20*c* of intake pipes 21 to 24 corresponds to a flange portion 82*b* that is formed at a second piece 82 that will be described later, and the intake pipe portion 20 is connected to the cylinder head 116 via the flange portion 82*b*.

(The Detailed Configuration of the Intake Apparatus Main Body)

Figure 3:
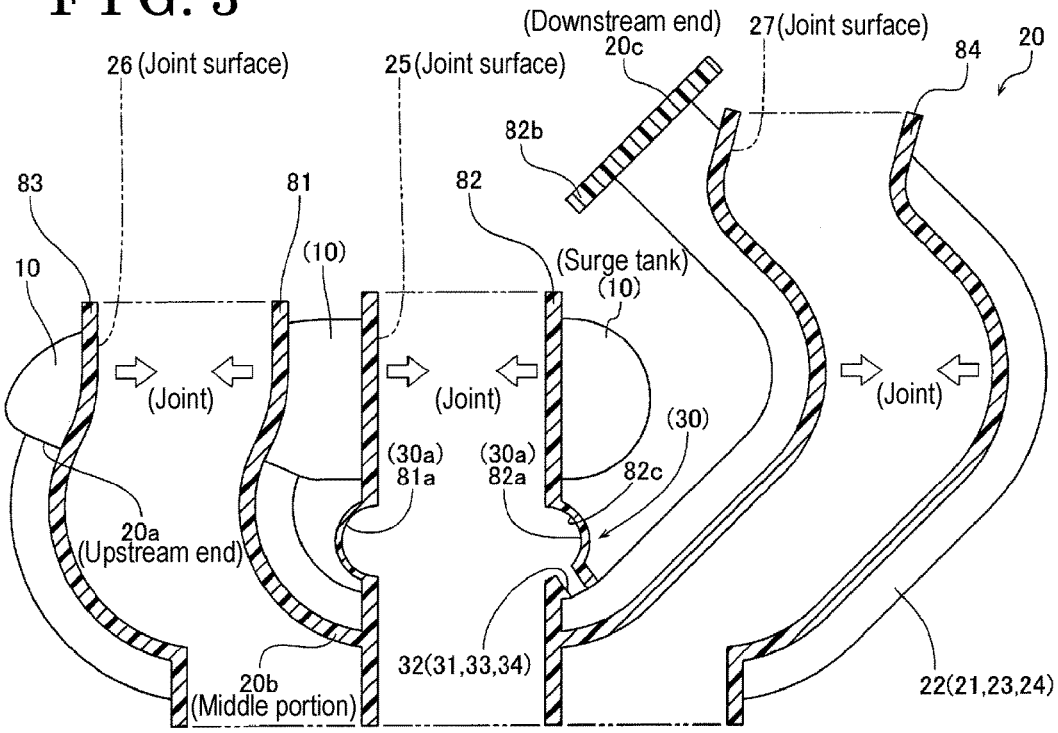
FIG. 3 is a view illustrating the intake apparatus of the embodiment of the present invention exploded into each of piece members.

As shown in FIG. 3, the intake apparatus main body 80 is formed such that a first piece 81, a second piece 82, a third piece 83, and a fourth piece 84 that are made of resin are integrally joined with one another by vibration welding. That is, the first piece 81 and the second piece 82 are joined with each other by a joint surface 25, the first piece 81 and the third piece 83 are joined with each other by a joint surface 26, and the second piece 82 and the fourth piece 84 are joined with each other by a joint surface 27. The joint surface 25 extends linearly and the joint surfaces 26, 27 each include a linear part and a curved (curved surface) part.

As illustrated in FIG. 1, as a positioning of each of the pieces, the first piece 81 forms an upstream section and a curved inner portion from the surge tank 10 (the side wall portion 11) to the intermediate portion 20*b* of the intake pipe portion 20. The second piece 82 forms a downstream section and the curved inner portion from the intermediate portion 20*b* to the downstream end 20*c* of the intake pipe portion 20. The third piece 83 forms the upstream section and the curved outer portion from the surge tank 10 (the side wall portion 11) to the intermediate portion 20*b* of the intake pipe portion 20. The fourth piece 84 forms the downstream section and the curved outer portion from the intermediate portion 20*b* to the downstream end 20*c* of the intake pipe portion 20. The intake pipes 21 to 24 (see FIG. 2) constituting the intake pipe 20 are divided similarly into four areas that are the upstream section, the downstream section, the curved inside and the curved outside by the first piece 81 to the fourth piece 84.

(The Disposition Configuration of the EGR Gas Passage)

Here, in the embodiment, as shown in FIGS. 1 and 2, the intake apparatus 100 includes an EGR gas passage 30 (an example of the external gas passage) for introducing the EGR gas to the intake apparatus main body 80. In this case, as illustrated in FIG. 1, the EGR gas passage 30 is positioned at an inner circumferential side of the curved intake pipe portion 20 (the intake pipes 21 to 24) and is disposed so as to be contained in the inner circumferential side of the intake pipes 21 to 24. In other words, the EGR gas passage 30 is configured to be positioned at an area A (a vacant space) generated by the facing of the upstream end 20*a* and the intermediate portion 20*b* of the intake pipes 21 to 24 by the curving thereof. The EGR gas passage 30 is configured to form a shape (a hollow shape) by the joint surface 25 between the first piece 81 (the piece corresponding to the upstream section and the curved inner side) and the second piece 82 (the piece corresponding to the downstream section and the curved inner side) that both constitute the inner circumferential part of the curved intake pipe portion 20 (the intake pipes 21 to 24).

The EGR gas passage 30 has a role distributing the EGR gas recirculated to the engine 110 to the intake pipes 21 to 24 corresponding to the cylinders 111 to 114, respectively.

Specifically, as illustrated in FIG. 2, the EGR gas passage 30 is provided with a single gas introduction passage portion 30*a* and a gas distribution passage portions 31 to 34 (4 portions in total), the gas introduction passage portion 30*a* that is provided so as to extend in an arrangement direction (in the X-axis direction) of the intake pipes 21 to 24 and that is introduced with the EGR gas passing through the EGR valve (not illustrated), the gas distribution passage portions 31 to 34 that are provided so as to connect the gas introduction passage portion 30*a* to the intake pipes 21 to 24 and that divide the EGR gas introduced to the gas introduction passage portion 30*a* to the intake pipes 21 to 24.

As illustrated in FIG. 3, the first piece 81 includes a first passage component 81*a* extending along the X-axis and including an inner wall surface that is dent so as to include a semicircular cross-sectional surface of the passage. Meanwhile, in the embodiment, the second piece 82 is provided with a second passage component 82*a* that includes a gutter portion 82*c* and the gas distribution passage portions 31 to 34 (shown with a dotted line in FIG. 2), the gutter portion 82*c* that extends along the X axis and that has an inner wall surface being dent so as to include a semicircular cross-sectional surface of the passage, the gas distribution passage portions 31 to 34 that are formed in a hole shape (a state of a through hole) extending from the gutter portion 82*c* towards the intake pipes 21 to 24 at the inner wall surfaces 21*d* to 24*d* (see FIG. 2) disposed at positions corresponding to each of the intake pipes 21 to 24. That is, the gas distribution passage portions 31 to 34 are not formed by the joint of the first piece 81 and the second piece 82, and the gas distribution passage portions 31 to 34 are originally and integrally formed with the second piece 82 by resin molding.

In the gas distribution passage portions 30*a* of the EGR gas passage portion 30, the first passage component 81*a* of the first piece 81 and the second passage component 82*a* of the second piece 82 are joined with each other by the joint surface 25 in a state of being disposed so as to face with each other. Accordingly, the gas introduction passage portion 30*a* is formed in a hollow cylindrical shape at an inner wall surface (the inner surface). By the joint of the first piece 81 and the second piece 82 at the joint surface 25, as illustrated in FIG. 2, the gas distribution passage portions 31 to 34 are configured to be separately connected to positions of the gas introduction passage portion 30*a* extending along the X axis, the positions corresponding to the intake pipes 21 to 24. The gas distribution passage portions 31 to 34 are connected to the intake pipes 21 to 24, respectively, at the intermediate portion 20*b* (in the vicinity of a border line between the upstream section and the downstream section) of the intake pipe portion 20.

In the embodiment, as shown in FIG. 1, the gas distribution passage portion 34 of the EGR gas passage 30 is provided at the curved inner wall surface 24*d* of the intake pipe 24 so as to open towards the downstream side in the intake flow direction. Meanwhile, the gas distribution passage portions 31 to 33 include the same configuration as that of the gas distribution passage portion 34. This configuration is provided in order to inhibit a phenomenon in which the EGR gas introduced to the intake pipes 21 to 24 is inhibited from flowing back towards the surge tank 10 communicating the intake pipes 21 to 24 with one another at the upstream side caused by the intake pulsation occurred when each of the pistons 116 of the cylinders 111 to 114 perform a cycle of a suction, compression, expansion (combustion), and exhaustion at the engine 110 while including predetermined phase differences from one another.

The gas distribution passage portion 34 is connected to the inner wall surface 24*d* of the intake pipe 24 while including a down grade relative to a horizontal direction (the Y-axis direction) along the flow direction of the circulating EGR gas. The gas distribution passage portions 31 to 33 include the same configuration as that of the gas distribution passage portion 34. This configuration is provided in order to easily introduce condensed water to the intake pipes 21 to 24, the condensed water flowing down by the gas distribution passage portions 31 to 34 including the down grade even in a case where water (water vapor) included in the EGR gas comes to be the condensed water by being cooled while the EGR gas flows in the gas introduction passage portion 30*a*.

The distribution structure of the EGR gas included in the EGR gas passage 30 is formed such that, as illustrated in FIG. 2, the four gas distribution passage portions 31 to 34 are branched from the single gas introduction passage portion 30*a*. The distribution of the EGR gas from the gas introduction passage portion 30*a* to the intake pipes 21 to 24 via the four gas distribution passage portions 31 to 34 is precisely performed by the formation of the gas distribution passage portions 31 to 34 that are formed in a hole-shape (a state of the through hole) at the second piece 82. In FIG. 2, a state of the inner wall portion (an internal flow passage) of the gas introduction passage portion 30*a* and the gas distribution passage portions 31 to 34 are illustrated with dotted lines.

As illustrated in FIG. 1, the intake pipes 21 to 24 constituting the intake pipe portion 20 are connected in parallel to one another relative to the surge tank 10. In the intake apparatus 100, an intake air reaching the intake apparatus 100 via an air cleaner (not illustrated) and the throttle valve 120 serving as an intake passage enters the surge tank 10. The intake apparatus 100 of the in-line-four-cylinder engine 110 according to the embodiment is configured as described above.

Effects of the Embodiment

In the embodiment, the following effects may be attained.

In the embodiment, by the positioning of the EGR gas passage 30 at the inner circumferential side of the curved intake pipes 21 to 24, the EGR gas passage 30 may be disposed by efficiently using the area A (the vacant space) at the inner circumferential side of the curved intake pipes 21 to 24. Therefore, the whole intake apparatus 100 may be inhibited from increasing in size. Because the intake apparatus 100 is inhibited from increasing in size, the mountability of the intake apparatus 100 to the engine room of an automobile may be enhanced.

In the embodiment, by the provision of the EGR gas passage 30 to the joint surface 25 of the first piece 81 and the second piece 82 constituting the inner circumferential part of the curved intake pipes 21 to 24, the EGR gas passage 30 may be integrally provided with the intake apparatus 100 by using the first piece 81 and the second piece 82. Accordingly, the number of the components of the intake apparatus 100 may be inhibited from increasing.

In the embodiment, the first piece 81 to the fourth piece 84 being separatingly formed are joined with one another to form the intake apparatus main body 80, and the EGR gas passage 30 is formed at the boned surface 25 of the first piece 81 and the second piece 82 constituting the inner circumferential part of the curved intake pipes 21 to 24. Accordingly, an exclusive piece (a resin member) constituting the EGR gas passage 30 does not have to be provided, and the EGR gas passage 30 may be integrally formed with the intake apparatus main body 80 at the same time when the intake apparatus main body 80 is formed (when the first piece 81 to the fourth piece 84 are joined with each other). Accordingly, the intake apparatus 100 in which the man-hour for the joint process is reduced may be obtained.

In the embodiment, the EGR gas passage 30 is configured with the single gas introduction passage portion 30*a* provided so as to extend in the arrangement direction of the intake pipes 21 to 24, and the gas distribution passage portions 31 to 34 dividing the EGR gas introduced to the gas introduction passage portion 30*a* to each of the intake pipes 21 to 24. Accordingly, by the efficient use of the area A (vacant space) at the inner circumferential side of the curved intake pipes 21 to 24, the distribution structure of the external gas (EGR gas) being provided with single gas introduction passage portion 30*a* and the gas distribution passage portions 31 to 34 dividing the external gas to each of the intake pipes 21 to 24 may be easily provided.

In the embodiment, the EGR gas passage 30 is configured so as to be positioned at the area A (vacant space) where the upstream end 20*a* of the curved intake pipes 21 to 24 and the intermediate portion 20*b* face with each other. Accordingly, the EGR gas passage 30 may be integrally provided with the intake apparatus main body 80, the EGR gas passage 30 that is formed by the first piece 81 and the second piece 82 constituting the inner circumferential part of the intake pipes 21 to 24 at the curved inner circumferential side that is curved until the upstream end 20*a* and the intermediate portion 20*b* of the intake pipes 21 to 24 face with each other. Accordingly, the rigidity of the intake apparatus main body 80 configured by the curved plural intake pipes 21 to 25 may be enhanced by the efficient use of the area A at the inner circumferential side of the intake pipes 21 to 24 and by positioning the EGR gas passage 30.

In the embodiment, the gas introduction passage portion 30*a* is formed by the joint of the first passage component 81*a* of the first piece 81 and the second passage component 82*a* of the second piece 82 so as to face with each other. The gas distribution passage portions 31 to 34 are formed in a hole shape at the second piece 82. Accordingly, because the gas distribution passage portions 31 to 34 dividing the external gas to each of the intake pipes 21 to 24 are integrally provided with the second piece 82 side so as to be formed in a hole shape at the second piece 82, the shape of the gas distribution passage portions 31 to 34 is not distorted caused by the difference at the time of the joint even in a case where the difference occurs between the first piece 81 and the second piece 82 at the time of the joint. That is, since the passage cross-sectional area (the passage cross-sectional shape) of the gas distribution passage portions 31 to 34 is not affected by the difference between the first piece 81 and the second piece 82 when being joined with each other, the distribution precision of the external gas circulating in the gas distribution passage portions 31 to 34, the distribution precision to the corresponding intake pipes 21 to 24, may be highly maintained.

In the embodiment, the gas distribution passage portions 31 to 34 are provided so as to open toward the downstream side at the inner wall surfaces 21*d* to 24*d* of the intake pipes 21 to 24, respectively. Accordingly, because the EGR gas sent from the gas distribution passage portions 31 to 34 is introduced towards the downstream in the intake flow direction of the intake pipes 21 to 24, the EGR gas introduced to each of the intake pipes 21 (22, 23, 24) caused by the intake pulsation of the engine 110 when the cylinders 111 to 114 perform the cycle of suction, compression, expansion (combustion), and exhaustion while including predetermined phase differences from one another is inhibited from flowing back towards the upstream side in the intake flow direction. That is, even in a case where the engine 110 generates the intake pulse, the distribution precision of the EGR gas to the intake pipes 21 to 24 may be highly maintained.

In the embodiment, the gas distribution passage portions 31 to 34 are connected to the intake pipes 21 to 24, respectively, at the intermediate portion 20*b* (in the vicinity of a border line between the upstream section and the downstream section) of the intake pipe portion 20. Accordingly, because the EGR gas may be introduced to the intake pipes 21 to 24 via the distribution passage portions 31 to 34 disposed at a position away from the cylinders 111 to 114 of the engine 110 to the upstream side, the chronic supercharging effect may be inhibited from decreasing unlike a case where each of the cylinders of the engine 110 communicates with each other in a short distance via the EGR gas passage 30.

In the embodiment, by the containment (inclusion) of the EGR gas passage 30 sending the EGR gas (the Exhaust Gas Recirculation gas) at the inner circumferential side of the curved intake pipes 21 to 24, the EGR gas circulating in the EGR gas passage 30 is inhibited from being directly affected with external air (external temperature) by the intake apparatus main body 80 (the first piece 81 and the second piece 82 constituting the inner circumferential part of the curved intake pipes 21 to 24). Accordingly, even in a case where the engine 110 is operated under the condition of a low external temperature (below-zero temperature), the warm EGR gas is inhibited from being cooled within the EGR gas passage 30 by being affected by the external air (for example, the travelling wind) because the heat retaining properties of the EGR gas passage 30 are enhanced. That is, because the water (the water vapor) included in the EGR gas that is recirculated to the engine 110 may be inhibited from being condensed by being cooled within the EGR gas passage portion 30, the accidental fire may be inhibited from occurring at the combustion chamber 115. Furthermore, a deposit (an attachment) caused by the condensed water may be inhibited from being generated in the EGR gas passage 30. As a result, the engine performance (fuel consumption) may be enhanced while inhibiting the engine quality from degrading.

In the embodiment, the surge tank 10 is connected to the upstream end 20*a* of the intake pipes 21 to 24, and the EGR gas passage 30 is disposed at the area A where the surge tank 10 and the intermediate portion 20*b* of the intake pipes 21 to 24 face with each other. As such, even the intake apparatus main body 80 in which the surge tank 10 temporarily stores the intake air passing through the throttle valve 120 is provided at the upstream of the intake pipe portion 20 (the intake pipes 21 to 24), the EGR gas passage 30 may be provided by the effective use of the area A (vacant space) where the surge tank 10 and the intermediate portion 20*b* of the intake pipes 21 to 24 face with each other. As a result, the mountability of the intake apparatus 100 including the surge tank to the engine room may be efficiently enhanced.

Modified Example

The embodiment disclosed here is an example in all aspects and does not intend to limit a scope of the invention. The scope of the present invention is described by a scope of claims, not an explanation of the aforementioned embodiment, and includes all modifications (modified examples) within the scope of the claims and the meaning and scope of equivalents.

For example, in the aforementioned embodiment, the gas distribution passage portions 31 to 34 are separately connected to the positions corresponding to the intake pipes 21 to 24, respectively, at the inner wall surface (the gutter portion 82*c*) of the gas introduction passage portion 30*a* extending along the X-axis, however, the present invention is not limited thereto. For example, a gas distribution passage may be formed at an intake apparatus main body to distribute the EGR gas to the intake pipes 21 to 24 as long as the EGR gas passage is disposed at the inner circumferential side of the curved intake pipes 21 to 24, the gas distribution passage including, for example, a tournament form in which a single gas introduction passage portion is branched into two and each of the branched passages is further branched into two. Furthermore, the present invention may be applied to an intake apparatus 200 (see FIG. 4) being connected to an internal combustion engine having a number of cylinders of multiples of three (for example, 3 cylinders 6 cylinders, 12 cylinders).

Figure 4:
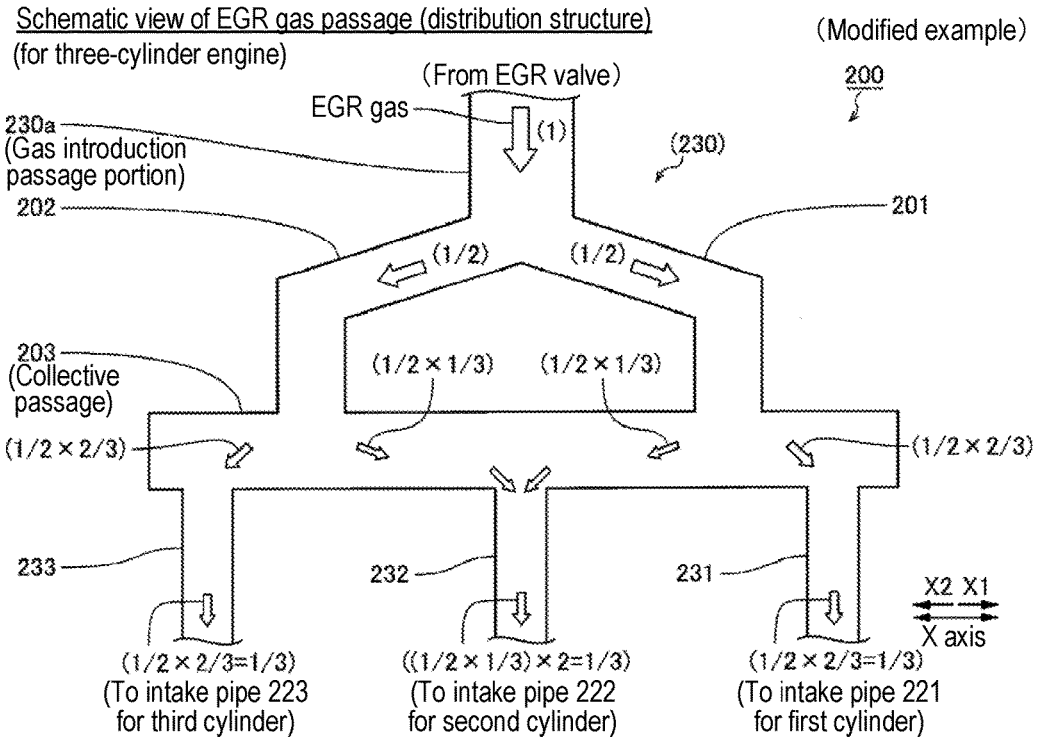
FIG. 4 is a view schematically illustrating a flow passage configuration of an EGR gas passage of a modified example of the present invention.

For example, as shown in a modified example illustrated in FIG. 4, an EGR gas distribution structure including a gas introduction passage portion 230*a*, a passage 201 and a passage 202, a collective passage 203, and gas distribution passage portions 231 to 233 may be provided. The gas introduction passage portion 230*a* is introduced with the EGR gas passing through an EGR valve (not illustrated). The passage 201 and the passage 202 are formed such that the gas introduction passage portion 230*a* is branched into two. The collective passage 203 recollects the passage 201 and the passage 202. The collective passage 203 is branched into three to form the gas distribution passage portions 231 to 233 that are connected to intake pipes 221 to 223, respectively. In the EGR gas distribution structure, an EGR gas passage 230 (an example of an external gas passage) may be disposed at an inner circumferential side of the curved intake pipes 221 to 223 as illustrated in FIG. 1. FIG. 4 schematically illustrates a state (configuration) where the half of the EGR gas circulating in the gas introduction passage portion 230*a* flows in each of the passage 201 and the passage 202, and one-third of the EGR gas is finally and equally distributed to the gas distribution passage portions 231 to 233 via the collective passage 203. By the use of such EGR gas passage 230, the intake apparatus 200 may be inhibited from increasing in size while highly maintaining the distribution precision (a state of being divided equally (by one-third)) of the EGR gas supplied to each of the cylinders of the internal combustion engine (for example, three-cylinder engine) having the number of cylinders of multiples of three.

In the aforementioned embodiment and the modified example, the EGR gas passage 30 (230) is provided at the curved inner circumferential side relative to the intake pipe portion 20 that extends upward while being curved in the anticlockwise direction by making the obliquely-downward of the surge tank 10 as a starting point, and that is connected to the cylinder head 116 by passing through the upward of the surge tank 10, however, the present invention is not limited thereto. For example, the EGR gas passage 30 (230) may be configured to be provided at the curved inner circumferential side of an intake pipe portion relative to an intake apparatus including the intake pipe portion being connected to the cylinder head 116 while being curved in a downward direction (in the clockwise direction) from the surge tank 10.

In the aforementioned and the modified example, the gas distribution passage portions 31 to 34 are formed in a hole shape at the second piece 82, however, the present invention is not limited thereto. That is, the gas distribution passage portions 31 to 34 may be formed in a hole shape at the first piece 81 side.

In the aforementioned and the modified example, an example in which the section between the upstream end 20*a* and the intermediate portion 20*b* of the intake pipe portion 20 is curved by approximately 120 degrees in the anticlockwise direction, however, the present invention is not limited thereto. That is, the degree of the curvature (the rotary angle) may be greater than 120 degrees or smaller than 120 degrees as long as the EGR gas passage 30 (230) is disposed (contained) in the curved inner circumferential side of the curved intake pipe portion 20.

In the aforementioned and the modified example, the gas distribution passage portions 31 to 34 (231 to 233) are connected to the intake pipes 21 to 24 (221 to 223) while having the down grade relative to the horizontal direction along the flow direction of the EGR gas, however, the present invention is not limited thereto. That is, the gas distribution passage portions 31 to 34 (231 to 233) may be configured to be connected to the intake pipes 21 to 24 (221 to 223) while maintaining horizontal posture along the flow direction of the EGR gas. A distal end (an opening portion to the intake pipe) of the downstream side of the gas distribution passage portions 31 to 34 may be slightly narrowed, or include a flat-shaped flow passage cross section.

In the aforementioned and the modified example, the present invention is applied to the EGR gas passage 30 distributing the EGR gas (the Exhaust Gas Recirculation gas) serving as an example of the external gas to each of the cylinders of the engine 110, however the present invention is not limited thereto. For example, the present invention may be applied to an external gas passage for distributing a blow-by gas (PCV (Positive Crankcase Ventilation gas) for ventilating a crank chamber of the engine 110 to each of the cylinders of the engine 110 as an external gas of the present invention.

In the aforementioned and the modified example, an example in which the present invention is applied to the intake apparatus 100 being connected to the in-line four-cylinder engine 110, however, the present invention is not limited thereto. For example, the present invention may be applied to an intake apparatus of an in-line engine, a V engine, or a horizontally opposed engine including plural cylinders of other even numbers (6 cylinders, 8 cylinders, 12 cylinders, for example).

In the aforementioned and the modified example, an example in which the present invention is applied relative to the intake apparatus for the engine 110 serving as a gasoline engine is described, however, the present invention is not limited thereto. The present invention may be applied relative to an intake apparatus for, for example, a diesel engine and a gas engine.

In the aforementioned and the modified example, an example in which the intake apparatus of the present invention is applied to the engine 110 for the automobile is described, however, the present invention is not thereto. The intake apparatus of the present invention may be applied to an internal combustion engine other than the engine for the automobile. Furthermore, the present invention may be applied to an intake apparatus being mounted on an internal combustion engine of a transportation device of, for example, a train or a vessel, and an internal combustion engine mounted on a stationary equipment device other than the transportation device.

EXPLANATION OF REFERENCE NUMERALS

21-24, 221-223: intake pipe: 25, 26, 27: joint surface; 30, 230: EGR gas passage (external gas passage); 30*a*, 230*a*: gas introduction passage portion, 31-34, 231-233: gas distribution passage portion (the second passage component), 80: intake apparatus main body, 81: first piece, 81*a*: first passage component, 82: second piece, 82*a*: second passage component, 83: third piece, 84: fourth piece, 100, 200: intake apparatus (intake apparatus of internal combustion engine), 110: engine (internal combustion engine)

The invention claimed is:

1. An intake apparatus of an internal combustion engine, comprising:

an intake apparatus main body including a plurality of intake pipes being connected to cylinders of the internal combustion engine, respectively, the internal combustion engine having the plurality of cylinders and an external gas passage distributing an exhaust gas recirculation gas discharged from a combustion chamber of the internal combustion engine to each of the plurality of intake pipes; wherein the intake apparatus main body is formed such that a plurality of pieces being formed so as to be divided from one another are joined with one another, and the plurality of intake pipes are formed so as to be curved;

the external gas passage is disposed at an inner circumferential side of the plurality of curved intake pipes, the external gas passage being provided at a joint surface of the plurality of pieces constituting an inner circumferential part of the plurality of curved intake pipes;

the plurality of intake pipes is formed so as to be curved until an upstream end of the plurality of intake pipes intersects with an intermediate portion of the plurality of intake pipes, and the external gas passage is disposed at an area where the upstream end and the intermediate portion of the plurality of curved intake pipes intersect.

2. The intake apparatus of the internal combustion engine according to claim 1, wherein the external gas passage includes:

a single gas introduction passage portion being provided so as to extend in an arrangement direction of the plurality of intake pipes, the gas introduction passage portion introducing the exhaust gas recirculation gas; and a plurality of gas distribution passage portions being provided so as to connect the gas introduction passage portion and the plurality of intake pipes, the gas distribution passage portion distributing the exhaust gas recirculation gas introduced to the gas introduction passage portion to each of the intake pipes.

3. The intake apparatus of the internal combustion engine according to claim 2, wherein the plurality of pieces constituting the inner circumferential part of the curved intake pipes is provided with a first piece including a first passage component and a second piece including a second passage component;

the gas introduction passage portion is formed such that the first passage component of the first piece and the second passage component of the second piece are joined with each other in a state of being disposed so as to face with each other; and the gas distribution passage portion is formed in a hole shape at the second piece.

4. The intake apparatus of the internal combustion engine according to claim 2, wherein the plurality of gas distribution passage portions is provided so as to open towards a downstream side at an inner wall surface of each of the intake pipes.

5. The intake apparatus of the internal combustion engine according to claim 1, wherein the upstream end of the plurality of intake pipes is connected to a surge tank; and the external gas passage is disposed at an area where the surge tank and the intermediate portion of the plurality of intake pipes face with each other.

6. The intake apparatus of the internal combustion engine according to claim 1, wherein the intake apparatus main body further includes a surge tank provided at the upstream end, the external gas passage is disposed between the surge tank and the plurality of intake pipes, and a housing of the external gas passage connects the surge tank provided at the upstream end to the intermediate portion at the inner circumferential side of the plurality of intake pipes.

* * * * *